US012145041B1

(12) United States Patent
Joseph et al.

(10) Patent No.: US 12,145,041 B1
(45) Date of Patent: Nov. 19, 2024

(54) BASKETBALL TRAINING DEVICE WITH MENTAL TRAINING FEATURE(S), RELATED SYSTEMS AND METHODS

(71) Applicant: Shoot-A-Way, Inc., Upper Sandusky, OH (US)

(72) Inventors: John G. Joseph, Upper Sandusky, OH (US); Brad Niley, Galena, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 0 days.

(21) Appl. No.: 18/616,948

(22) Filed: Mar. 26, 2024

(51) Int. Cl.

| | |
|---|---|
| ***A63B 69/00*** | (2006.01) |
| ***A63B 69/40*** | (2006.01) |
| ***A63B 71/06*** | (2006.01) |

(52) U.S. Cl.
CPC ..... *A63B 69/0071* (2013.01); *A63B 69/40* (2013.01); *A63B 71/0622* (2013.01); *A63B 2071/063* (2013.01); *A63B 2214/00* (2020.08); *A63B 2220/62* (2013.01); *A63B 2220/802* (2013.01); *A63B 2220/807* (2013.01); *A63B 2220/808* (2013.01); *A63B 2220/89* (2013.01)

(58) Field of Classification Search
CPC . A63B 69/0071; A63B 69/40; A63B 71/0622; A63B 2071/063; A63B 2214/00; A63B 2220/62; A63B 2220/802; A63B 2220/807; A63B 2220/808; A63B 2220/89
See application file for complete search history.

(56) References Cited

U.S. PATENT DOCUMENTS

| | | | |
|---|---|---|---|
| 6,659,893 | B1 | 12/2003 | Campbell et al. |
| 7,094,164 | B2 | 8/2006 | Marty et al. |
| 7,850,552 | B2 | 12/2010 | Marty et al. |
| 7,854,669 | B2 | 12/2010 | Marty et al. |
| 8,012,046 | B2 | 9/2011 | Campbell et al. |
| 8,147,356 | B2 | 4/2012 | Campbell et al. |
| 8,408,982 | B2 | 4/2013 | Marty et al. |
| 8,409,024 | B2 | 4/2013 | Marty et al. |
| 8,617,008 | B2 | 12/2013 | Marty et al. |
| 8,622,832 | B2 | 1/2014 | Marty et al. |
| 8,852,030 | B2 | 10/2014 | Campbell et al. |
| 8,908,922 | B2 | 12/2014 | Marty et al. |
| 8,948,457 | B2 | 2/2015 | Marty et al. |
| D739,488 | S | 9/2015 | Campbell et al. |
| 9,238,165 | B2 | 1/2016 | Marty et al. |

(Continued)

OTHER PUBLICATIONS

Fit Light Training, Stephen Curry: Training Redefined, webpage article, accessed Mar. 13, 2024, 4 pages.

*Primary Examiner* — Jeffrey S Vanderveen
(74) *Attorney, Agent, or Firm* — Standley Law Group LLP; Jeffrey S. Standley; Adam J. Smith

(57) ABSTRACT

Systems, methods, and devices for providing mental training during a basketball practice session are provided. A controller receives indication of user selection of a decision mode for the basketball practice session. A custom library of selected basketball moves and associated codes for the basketball practice session is generated by the controller. Before and/or while each basketball is commanded by the controller to be passed by a launching device of a basketball passing machine for the basketball practice session, the controller causes display of one of the associated codes at an electronic display. In this way, the user must recall the move associated with the code.

20 Claims, 10 Drawing Sheets

(56) References Cited

U.S. PATENT DOCUMENTS

| | | | | |
|---|---|---|---|---|
| 9,283,431 | B2 | 3/2016 | Marty et al. | |
| 9,283,432 | B2 | 3/2016 | Marty et al. | |
| 9,345,929 | B2 | 5/2016 | Marty et al. | |
| 9,358,455 | B2 | 6/2016 | Marty et al. | |
| 9,370,704 | B2 | 6/2016 | Marty et al. | |
| 9,390,501 | B2 | 7/2016 | Marty et al. | |
| 9,694,238 | B2 | 7/2017 | Marty et al. | |
| 9,697,617 | B2 | 7/2017 | Marty et al. | |
| 9,724,584 | B1 | 8/2017 | Campbell et al. | |
| 9,734,405 | B2 | 8/2017 | Marty et al. | |
| 9,808,696 | B2 | 11/2017 | Campbell et al. | |
| 9,886,624 | B1 | 2/2018 | Marty et al. | |
| 9,914,035 | B2 | 3/2018 | Campbell et al. | |
| 9,975,026 | B2 | 5/2018 | Campbell et al. | |
| 10,010,778 | B2 | 7/2018 | Marty et al. | |
| 10,092,793 | B1 | 10/2018 | Marty et al. | |
| 10,252,133 | B2 | 4/2019 | Campbell et al. | |
| 10,315,090 | B2 | 6/2019 | Campbell et al. | |
| 10,343,015 | B2 | 7/2019 | Marty et al. | |
| 10,360,685 | B2 | 7/2019 | Marty et al. | |
| 10,471,325 | B2 | 11/2019 | Marty et al. | |
| 10,561,916 | B1 | 2/2020 | Campbell et al. | |
| 10,596,436 | B1 | 3/2020 | Campbell et al. | |
| 10,610,757 | B1 | 4/2020 | Marty | |
| 10,762,642 | B2 | 9/2020 | Marty et al. | |
| 10,956,723 | B2 | 3/2021 | Marty et al. | |
| 10,994,182 | B1 | 5/2021 | Campbell et al. | |
| 11,049,258 | B2 | 6/2021 | Marty et al. | |
| 11,097,176 | B1 | 8/2021 | Campbell et al. | |
| 11,123,605 | B1 | 9/2021 | Marty | |
| 11,135,500 | B1 | 10/2021 | Campbell et al. | |
| 11,247,109 | B1 | 2/2022 | Campbell et al. | |
| 11,263,461 | B2 | 3/2022 | Marty et al. | |
| 11,413,514 | B2 * | 8/2022 | Marty | A63B 24/0021 |
| 11,450,106 | B2 | 9/2022 | Marty et al. | |
| 11,491,383 | B1 | 11/2022 | Campbell et al. | |
| D972,675 | S | 12/2022 | Campbell et al. | |
| 11,577,139 | B1 | 2/2023 | Campbell et al. | |
| 11,715,214 | B1 | 8/2023 | Marty et al. | |
| 11,813,510 | B1 | 11/2023 | Campbell et al. | |
| 11,836,929 | B2 | 12/2023 | Marty et al. | |
| 11,890,521 | B1 | 2/2024 | Campbell et al. | |
| 11,896,884 | B2 | 2/2024 | Marty et al. | |
| 2008/0200287 | A1 | 8/2008 | Marty et al. | |
| 2014/0301601 | A1 | 10/2014 | Marty et al. | |
| 2017/0232298 | A1 * | 8/2017 | Joseph | A63B 69/40 473/433 |
| 2022/0415048 | A1 | 12/2022 | Marty et al. | |
| 2024/0071140 | A1 | 2/2024 | Marty et al. | |
| 2024/0087137 | A1 | 3/2024 | Marty et al. | |

* cited by examiner

102

Decision Mode

Performance Report for Player John Doe

| Shot Type | Shots made (%) |
|---|---|
| Shot fake, floater | X% |
| Step back | Y% |
| Shoot now | Z% |
| Shot off, right dribble | A% |
| Shot off, left dribble | B% |

| Shot Location | Shots made (%) |
|---|---|
| Spot 0 | X% |
| Spot 1 | Y% |
| Spot 2 | Z% |
| ... | .... |

Figure 7

BASKETBALL TRAINING DEVICE WITH MENTAL TRAINING FEATURE(S), RELATED SYSTEMS AND METHODS

CROSS-REFERENCE TO RELATED APPLICATIONS

This application is a filed as original and therefore makes no priority claim.

TECHNICAL FIELD

Exemplary embodiments relate generally to basketball training device, such as a basketball passing machine, with mental training feature(s), such as for reaction speed and/or memory recall, and related systems and methods.

BACKGROUND AND SUMMARY OF THE INVENTION

Basketball training devices are known. Some such training devices include basketball passing machines which deliver basketballs to players stationed about a basketball court to practice shooting or other basketball skills. Examples of such devices include THE GUN® device from Shoot-A-Way, Inc. of Upper Sandusky, Ohio (www.shootaway.com) and the DR. DISH™ device from Airborne Athletics, Inc. of Minneapolis, Minnesota (www.drdishbascktball.com).

While physical training is important in basketball, mental training, which is sometimes neglected, has an important role in performance. Mental training may include a variety of facets, including but not necessarily limited to, reaction speed and/or memory recall. What is needed is a basketball training device which incorporates mental training.

A basketball training device which incorporates mental training feature(s) is provided. The basketball training device may include a basketball passing machine. The mental training feature(s) may be configured to train reaction speed and/or memory recall, for example without limitation. In exemplary embodiments, without limitation, a user selects a metal training mode (sometimes referred to herein as a "decision mode"). Certain basketball moves may be selected manually by the user or automatically assigned (e.g., randomly). Some or all available basketball moves may be used as part of a particular session (sometimes referred to herein as a "challenge"). For example, without limitation, the user may select a subset of available basketball moves for the session from a predetermined list of available basketball moves. As another example, without limitation, a controller (e.g., for the basketball passing machine) may automatically select a subset of the available basketball moves to include. A unique code may be automatically (e.g., randomly) or manually assigned by the user for each of the selected basketball moves of the session. For example, without limitation, the user may select a code to assign to each selected basketball move from a predetermined list of available codes. As another example, without limitation, the controller may automatically assign a unique code to each of the selected basketball moves. Such selections may be made at a user interface (e.g., touch screen), which may be local to the basketball passing machine or remote therefrom (e.g., at separate smartphone, tablet, computer, etc.). Other user input may be provided, such as number and/or location of passes, player information (e.g., player and/or team identification and/or number of players). Otherwise, default settings may be provided.

Optionally, demonstrative images, videos, and/or descriptive text may be displayed, such as at a player facing electronic display located at the basketball passing machine or remote therefrom, of the basketball moves so the player understands the assigned/selected moves. The player facing display may be the same as the user interface or separate therefrom.

A custom library of assigned basketball moves may be created, such as at the controller, based on the user selections. Before each basketball pass is made, one of the codes is displayed at the player facing electronic display. The player facing electronic display may be located at the basketball passing machine or remote therefrom. Preferably, the code is displayed only briefly, though the code may be displayed continuously until a next code is displayed, for another duration, at intervals, or the like. As used herein, the term briefly may refer to a period of time of under one minute, preferably within about 5 seconds, more preferably under 3 seconds. Shortly after the code is initially displayed, simultaneously, or shortly before, a throwing mechanism is engaged to pass the basketball with, or shortly after, the code is initially displayed. As used herein, the term shortly may refer to a period of time of under one minute, preferably within about 5 seconds, more preferably under 3 seconds. In this way, the player may recall the basketball move assigned to the displayed code and perform the move before, with, and/or after receiving the basketball pass from the throwing mechanism, as appropriate for the assigned basketball move.

User performance (e.g., make/miss) may be determined based on data received (or not received) from a shots made detector. Preferably, the performance statistics are organized by player identification, team identification, basketball moves (e.g., assigned basketball move), shooting challenge (e.g., decision mode), combinations thereof, or the like. The process of displaying codes, engaging the throwing mechanism, and storing/updating performance statistics may be performed for all passes of the challenge until completed. While performance statistics may optionally be displayed during the challenge, the performance statistics for the entire challenge may, alternatively or additionally, be displayed upon completion.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical, similar, or equivalent features, and wherein:

FIG. 7 is a plan view of an exemplary performance report generated after operating the basketball training device in accordance with the logic of FIG. 6;

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
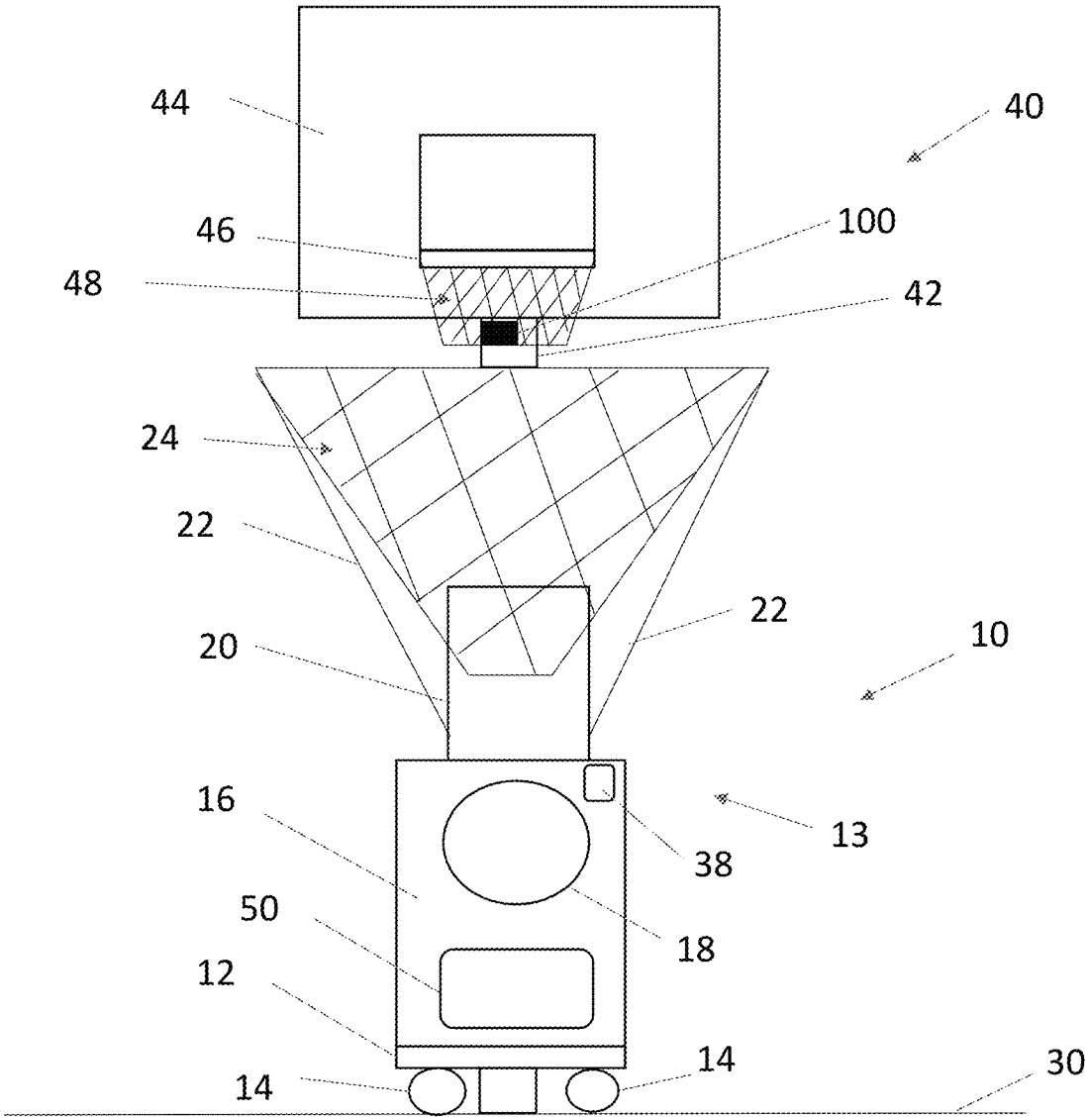
FIG. 1 is a front view of an exemplary basketball training device having a mental training feature or features located near a basketball goal on a playing area.
Figure 2:
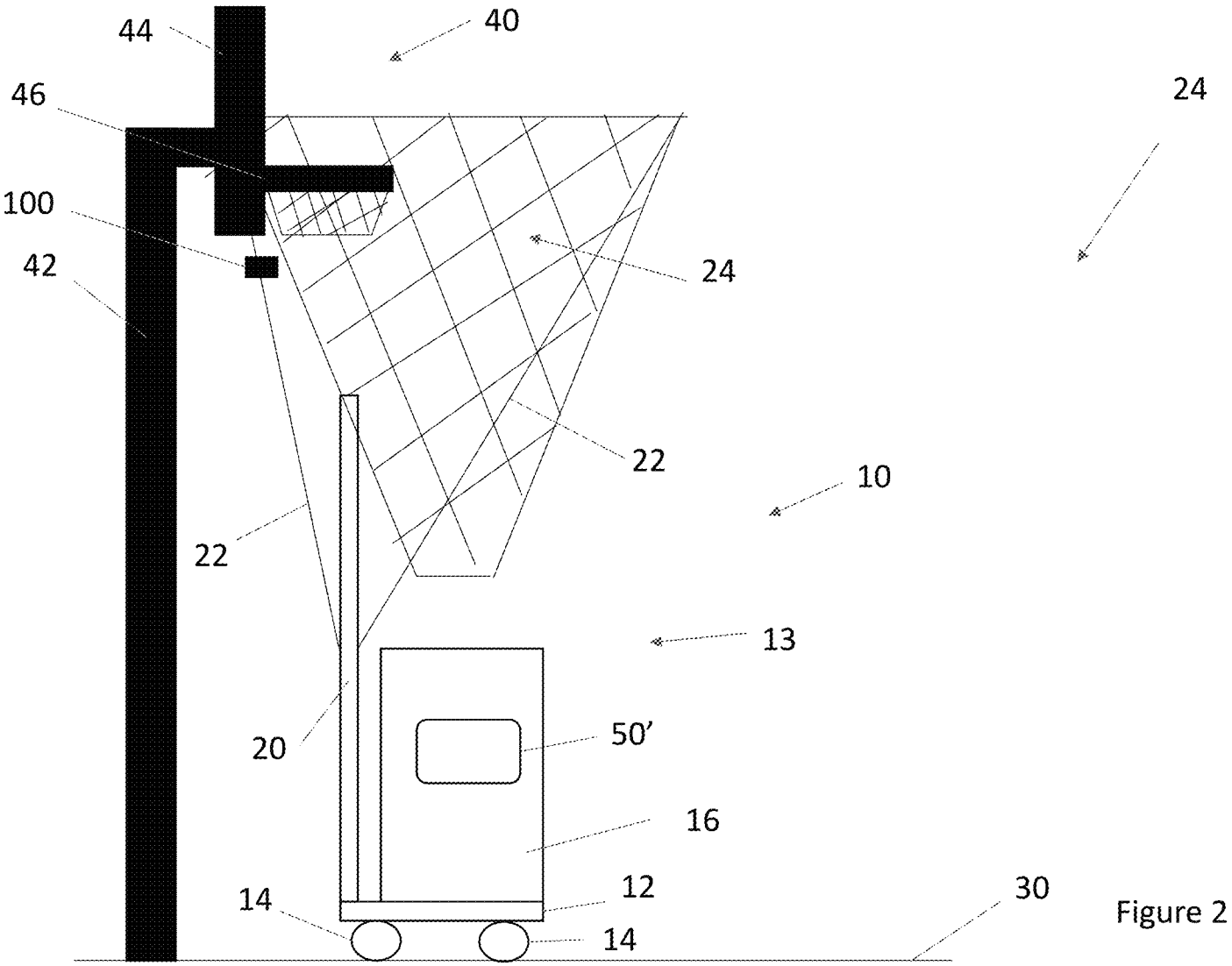
FIG. 2 is a side view of the FIG. 1 device.

FIG. 1 is a front view of an exemplary basketball launching device 10 and FIG. 2 is a side view of the basketball launching device 10. The basketball launching device 10 may comprise a support structure 12. The support structure 12 may comprise a frame, platform, rigid members, combinations thereof, or the like. One or more wheels 14 may be mounted to the support structure 12 which permit movement of the basketball launching device 10 around a playing area 30. A housing 16 may be mounted to the support structure 12. The housing 16, in exemplary embodiments, may be mounted to the support structure 12 in a rotatable manner. One or more apertures 18 may be located in the housing 16. At least a first one of the apertures 18 may be sized to permit basketballs 60 to be ejected therethrough to various pass receipt locations at the playing area 30. The first one of the apertures 18 may be located on a player facing surface of the housing 16 (e.g., forward/front surface) or at another location at the device 10 or remote therefrom visible to the player (e.g., overhead or remote electronic display), though any location may be utilized. A second one of the apertures 18 may be located on an upper portion of the housing 16 and may be sized to permit the basketballs to enter the housing 16 through the second one of the apertures 18. In other exemplary embodiments, the housing 16 is not required or is provided outside the travel path of the basketball.

The support structure 12 may comprise a frame 20, at least a portion of which may extend vertically. At least a portion of the frame 20 may be collapsible, though such is not required. The frame 20 may comprise one or more support members 22. At least some of said support members 22 may be adjustable in length. In exemplary embodiments, at least some of the support members 22 may comprise telescoping poles. In exemplary embodiments, four support members 22 may extend upwardly and outwardly from the support structure 12 in a splayed fashion, though any number and configuration of support members 22 may be utilized. The support member 22 may, in exemplary embodiments, be selectively collapsible.

A net 24 may be attached to one or more of the support members 22. Openings in the net 24 may be sized to prevent the basketballs 60 from passing therethrough. The net 24 may be configured to create a funnel shape when mounted to said support members 22 such that basketballs 60 gathered in the net 24 are directed towards the housing 16 where they may be received through one or more openings, such as but not limited to, the second one of the apertures 18. However, any size, shape, and type of net 24 may be utilized. Alternatively, or in addition, one or more guide tracks may extend between the bottom of the net 24 and the housing 16.

The basketball launching device 10 may be placed in proximity to a basketball goal 40 by a user, such as directly below a rim 46 of the goal 40. However, the device 10 may optionally be placed elsewhere about a playing area.

The basketball goal 40 may be regulation type, height, size and configuration, though such is not required. The basketball goal 40 may comprise a post 42 which extends to the playing area 30, a backboard 44, the rim 46, and a net 48, for example without limitation. For example, without limitation, the rim 46 may be positioned 10 feet above the playing area 30.

Some or all of the frame 20 may be adjustable. For example, without limitation, the frame 20 may comprise one or more mechanisms for collapsing the support members 22, the net 24, and/or the frame 20. In this way, the basketball launching device 10 may be selectively reduced in size. In exemplary embodiments, the basketball launching device 10 may be sufficiently reduced in size so as to fit through a standard size doorway, though such is not required. As another example, without limitation, the frame 20 may comprise one or more mechanisms for expanding the support members 22, the net 24, and/or the frame 20. In this way, the basketball launching device 10 may be selectively increased in size. In exemplary embodiments, the basketball launching device 10 may be positioned and sufficiently increased in size such that one or more upper edges of the net 24 extend above the rim 46 of the basketball goal 40 when so positioned. When expanded, the net 24 may create a sufficiently sized top opening to accommodate most, or all, of a user's made shots as well as at least some, or all, of the user's missed shots, which are gathered by the net 24 and returned to the housing 16.

In still other exemplary embodiments, adjustment of the net 24 may be achieved by adjustment of the support members 22, with or without adjustment of the frame 20. FIG. 1 illustrates an exemplary configuration of the basketball launching device 10 with the net 24 positioned below the rim 46 and FIG. 2 illustrates an exemplary configuration of the basketball launching device 10 with the net 24 positioned above the rim 46 of the basketball goal 40. Any height of the net 24 in a collapsed and/or expanded position may be utilized.

The support structure 12, the housing 16, the support poles 22, and/or the frame 20 may, at least in part, define a structural subassembly 13. The structural subassembly 13 may comprise one or more of the support structure 12, the housing 16, the support poles 22, and/or the frame 20. The term structural subassembly 13 may therefore refer to such components, or subcomponents thereof, collectively or individually.

An interface 50 may be provided for receiving user input and/or displaying information. The interface 50 may comprise one or more physically depressible buttons, electronic icons capable of direct or indirect selection, one or more electronic displays, one or more touch screens, combinations thereof, or the like. The interface 50 may be connected to the frame 20. Alternatively, the interface 50 may be mounted to the housing 16 or other component of the basketball launching machine 10. Any size, shape, or location of the interface 50 may be utilized.

Alternatively, or additionally, the interface 50 may be provided on one or more personal electronic devices 70 such as, but not limited to, a smartphone, a tablet, a personal computer, some combination thereof, or the like. Such personal electronic devices 70 may be physically separate from the basketball launching machine 10 or physically integrated therewith. For example, without limitation, the personal electronic devices 70 may be permanently mounted to one or more components of the basketball launching machine 10. In other exemplary embodiments, the personal electronic devices 70 may be configured for selective and/or temporary mounting to the frame 20, housing 16, or other component of the basketball launching machine 10 such as, but not limited to, by way of a holder or mounting device.

The device 10 may comprise one or more detectors 100 for detecting made and/or missed basketball shots. The detector(s) 100 may be connected to the device 10, such as mounted to the support members 22 or other portions of the structural subassembly 13, though such is not required. In other exemplary embodiments, without limitation, the detector(s) 100 may be attachable to portions of the basketball goal 40. The detector(s) 100 may be in wired or wireless connection with components of the device 10. The detector(s) 100 may be physically separate, or separable, from a remainder of the device 10. The detector(s) 100 may comprise photo eyes, ultrasonic sensors, lasers, cameras and/or machine vision software, paddles or other physical objects which are positioned, or configured to be positioned, within a pathway of the basketballs (e.g., below and/or within rim), switches, microphones, combinations thereof, or the like.

While illustrated at a forward portion of the housing 16, the interface 50 may be provided at other locations of the device 10 or remote therefrom (e.g., at the personal electronic devices 70). Optionally, or additionally, secondary displays/interfaces 50' may be provided at other locations, local to the device 10 or remote therefrom (e.g., at the personal electronic devices 70). The same or different information may be provided at the interface 50 and/or secondary display interfaces 50'. As used herein, the term interface 50 may include the secondary interface(s) 50' in the alternative or addition to the interface 50. The interface 50 may include one or more human-machine-interface ("HMI") elements, such as but not limited to, a touch screen (e.g., display with icons), buttons, switches, keyboards, keypads, mouse, joysticks, combinations thereof, or the like.

Figure 3:
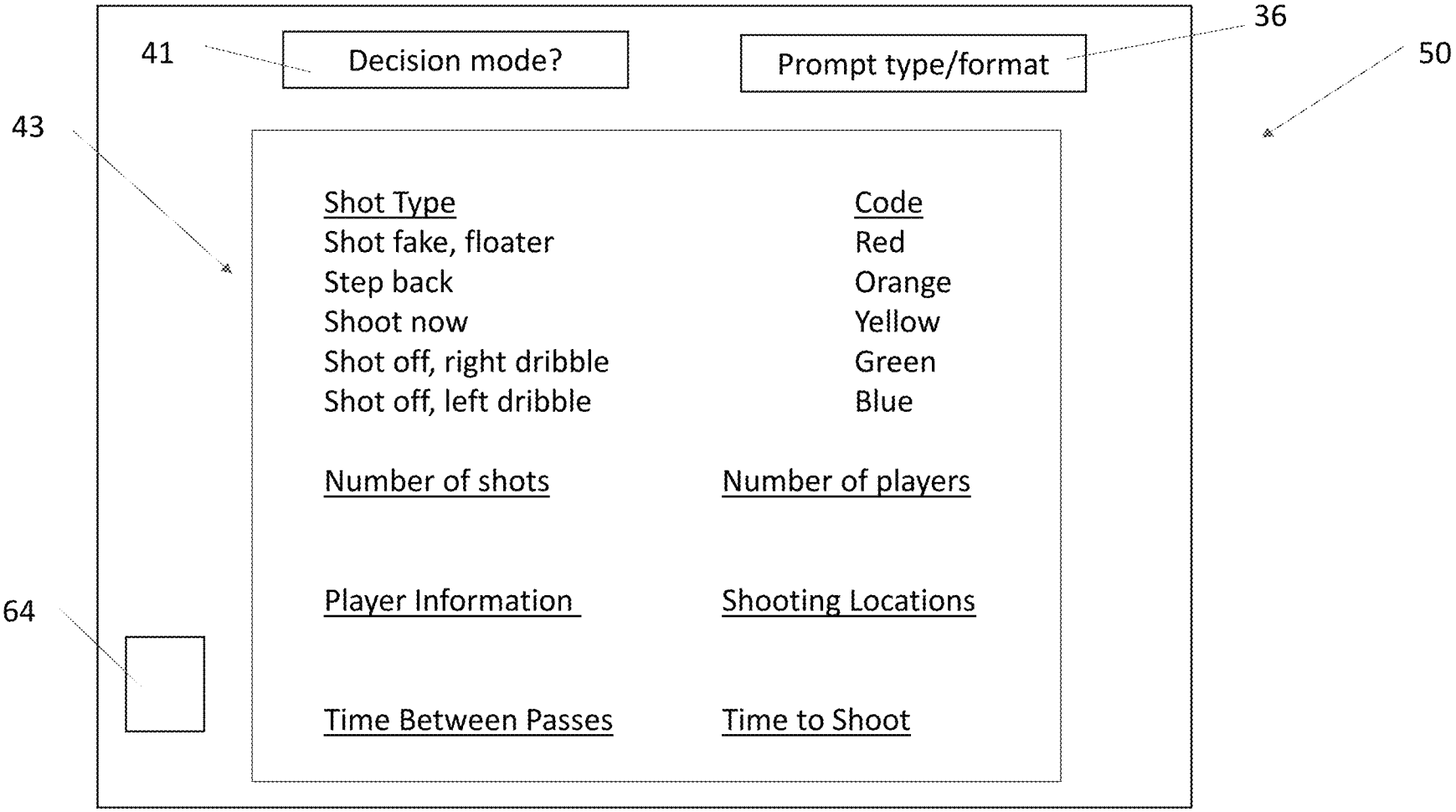
FIG. 3 is a front view of an exemplary basketball moves selection display for the FIG. 1 device.
Figure 4:
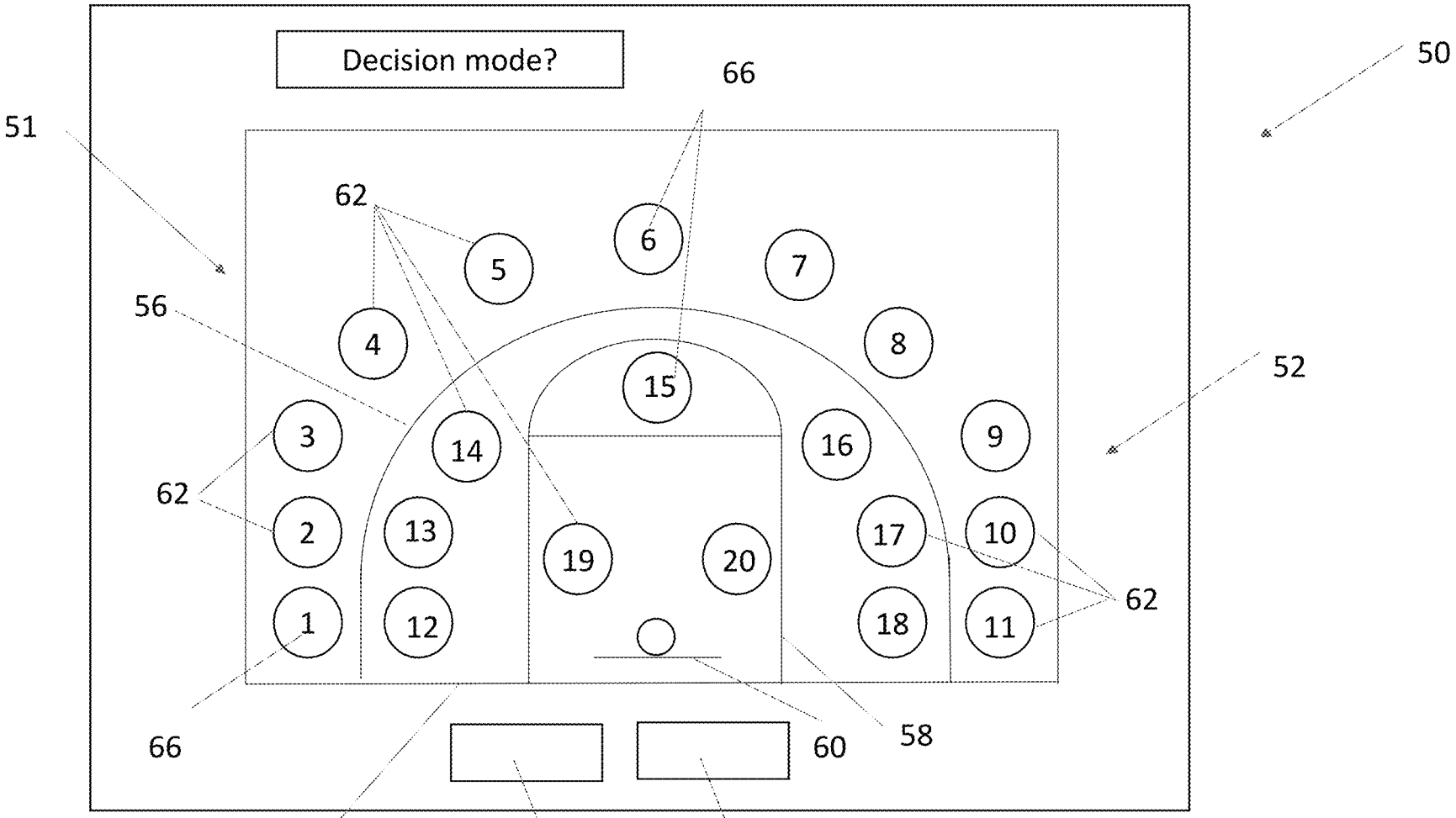
FIG. 4 is a front view of an exemplary location selection display for the FIG. 1 device.

FIG. 3 and FIG. 4 illustrate detailed views of the interface 50. A decision mode option 41 may be provided. The decision mode option 41 may be a selectable portion of the interface 50 (e.g., icon on a touch screen) or a dedicated HMI element (e.g., separate button or switch). Upon selection of the decision mode option 41, various user input options may be generated at one or more displays, including but not necessarily limited to, a basketball moves selection display 43 (exemplary embodiment of which is illustrated in FIG. 3, without limitation), and an exemplary location selection display 51 (exemplary embodiment of which is illustrated in FIG. 4, without limitation). The illustrated embodiments are by way of example and not intended to be limiting. For example, without limitation, the information and/or options shown and/or described herein may be provided at a same or different display, in different arrangements, combinations thereof, or the like.

As illustrated with particular regard to FIG. 3, the basketball moves selection display 43 may comprise icons representing various basketball moves, such as but not necessarily limited to, shot fake, floater, step back, shoot now (e.g., catch and shoot), shot off, right dribble (e.g., catch, dribble right, take shot), and shot off, left dribble (e.g., catch, dribble left, take shot). These are merely exemplary and not intended to be limiting. For example, without limitation, the basketball moves may include various type of shots (e.g., fixed, jumper, off the dribble, fade away, free throw, layup, three-pointer, etc.), various basketball skills (e.g., dribbling, cross overs, jukes, jab steps, etc.), various basketball movements (e.g., catch and pass, catch and shoot, dribble and then shoot, pick and roll, etc.), combinations thereof, or the like. As those of skill in the art will recognize, a wide variety of basketball moves and/or other physical moves (basketball related or otherwise) may be utilized.

The basketball moves selection display 43 may comprise icons representing various codes, such as but not necessarily limited to, colors, shapes, symbols, images, sounds, scents, combinations thereof, or the like. As those of skill in the art will recognize, a wide variety of codes 82 may be utilized. The basketball moves and/or colors illustrated in FIG. 3 are merely exemplary and not intended to be limiting. The code 82 may be, by way of non-limiting example, any symbol which represents the assigned basketball move to be performed without expressly showing or describing the move itself. Stated another way, the code 82 may essentially be arbitrary to the assigned basketball move.

Figure 8:
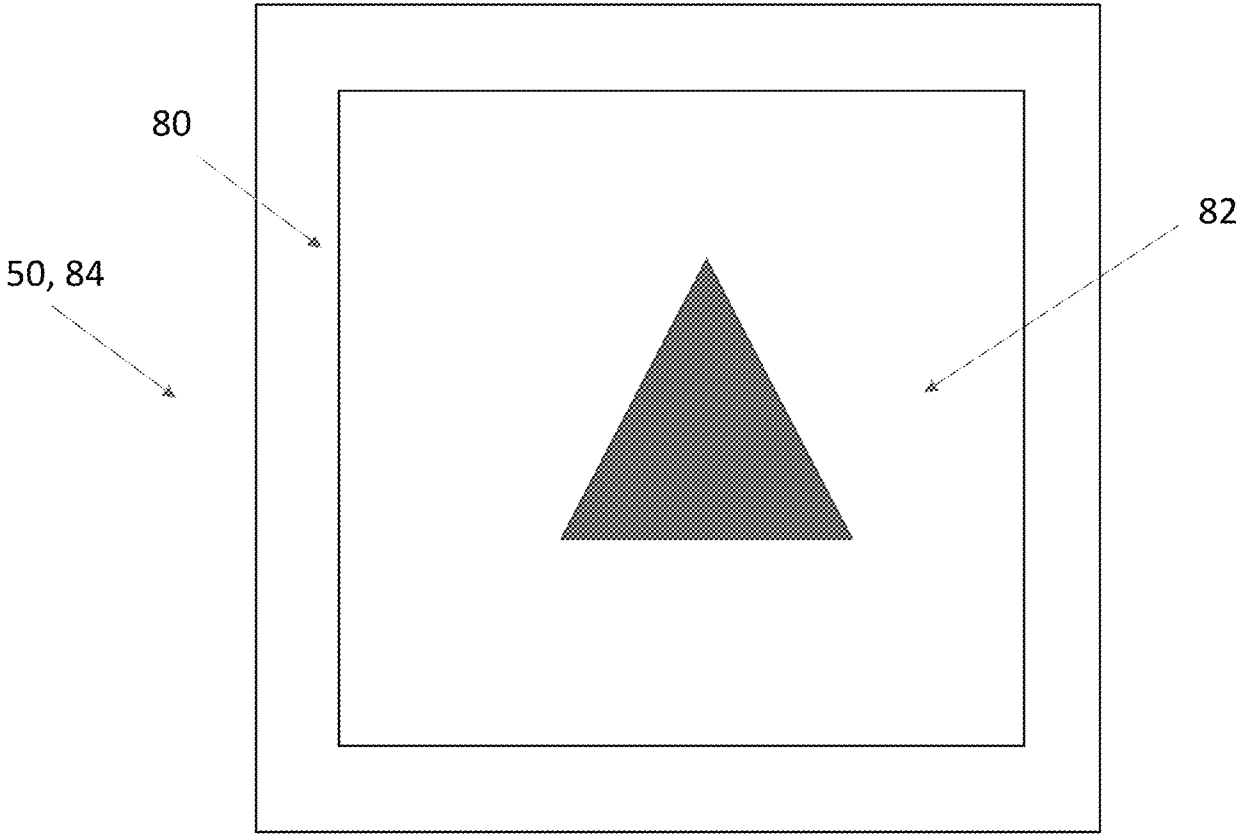
FIG. 8 is a plan view of an exemplary code display for use as part of the operations of FIG. 6 and/or the basketball training device of FIG. 1.

As further described herein, the codes 82 may be individually displayed to a player before and/or while a basketball pass is provided by the machine 10, thereby forcing the player to recall what basketball move is associated with the displayed code 82. Such codes 82 may preferably be displayed without any descriptive and/or or suggestive, text, images, videos, or the like. Such codes 82 may be provided at a code display 80, an exemplary embodiment of which is provided at FIG. 8, by way of non-limiting example. The code display 80 may comprise, or consists of, a respective one of the codes 82, such as without any descriptive and/or suggestive material regarding the basketball moves. In this way, the player is forced to recall what movement is associated with the displayed code 82. The codes 82 may serve as a prompt to the player which convey, though not directly or expressly, the basketball move to be performed.

The basketball moves selection display 43 may allow a user, who may be the player or a third party (e.g., coach, parent, etc.), to select basketball moves and/or associated codes 82 for a particular session/challenge. In other exemplary embodiments, and/or if no selection is made, codes 82 and/or basketball moves may be assigned automatically, such as on a random and/or default basis (e.g., utilize all basketball moves, utilize 5-10 randomly selected basketball moves, assign codes 82 randomly, assign codes 82 in a particular order, etc.).

The interface 50 and/or basketball moves selection display 43 may optionally comprise prompts, input fields, combinations thereof, or the like to gather other user input, such as but not necessarily limited to, a number of shots for the session, player information (e.g., name, ID number, team information, combinations thereof, or the like), a number of participating players (e.g., a default number may be 1), passing locations (alternatively, or additionally, provided as the location selection display 51), combinations thereof, or the like. While illustrated as part of a common display, these prompts, input fields, combinations thereof, or the like may be provided at other displays, locations, in other forms, combinations thereof, or the like.

As illustrated with particular regard to FIG. 4, the location selection display 51 may comprise a rendering, illustration, or other visual depiction 52 of elements of an exemplary playing area 30, such as but not limited to a regulation basketball court. The visual depiction 52 may comprise, for example without limitation, depictions of a baseline, a key, a three-point arc, a basketball goal, combinations thereof, or the like. Any size, shape, arrangement, type, or kind of such basketball playing area elements or regulation or non-regulation type playing areas may be provided as part of the visual depiction 52 on the interface 50.

The location selection display 51 may comprise a number of selectable areas 62. The selectable areas 62 may be located at various positions on the visual depiction 52 to correlate with pass receipt positions on the playing area 30. The selectable areas 62 may be selected by the user to create custom shooting arrangements. The selectable areas 62, in exemplary embodiments, may be visually depicted as indicia such as but not limited to a circle though any size, shape, color, type, or the like of such selectable areas 62 may be utilized.

The selectable areas 62 may be provided at various locations on the visual depiction 52. The selectable areas 62 may be circular in shape, though any size and shape selectable areas 62 may be utilized. The selectable areas 62 may be located at spaced angular positions along the visual depiction 52. For example, without limitation, a number of selectable areas 62 may be positioned on or along the visual depiction of the three-point arc 56. In exemplary embodiments, some of the selectable areas 62 may be located inside the three-point arc 56 and other selectable areas 62 may be located outside of the three-point arc 56, though such is not required. Alternatively, or in addition, some or all of the selectable areas 62 may be located within or around the visual depiction of the key 58. The selectable areas 62 may, alternatively or additionally, be provided in visual correlation to a visual depiction of a baseline 54. Any size, shape, number, or arrangement of selectable areas 62 may be utilized.

Each of the selectable areas 62 may comprise one or more markers 66. The markers 66 may comprise numbers, letter, symbols, some combination thereof or the like. The markers 66 may provide nomenclature for the selectable areas 62 as well as the corresponding shooting positions on the playing area. The interface 50 may be configured to monitor for, and/or receive, a user selection of one or more of the selectable areas 62 to create a custom basketball practice arrangement. The selectable areas 62 may be individually selected by physical touch in a direct or indirect manner. The selectable areas 62 may form input locations for receiving user input.

Alternatively, or in addition to the embodiments, described herein, a number of predetermined sets of selectable areas 62 may be preprogrammed to define pre-made practice arrangements. Such pre-made practice arrangements may be made available by way of certain ones of said selectable areas 62. In such embodiments, the interface 50 may be configured to permit the user to select one or more such predetermined programs as an alternative to, or in addition to, creating a custom practice arrangement.

The selectable areas 62 may be arranged on the visual depiction 52 to visually correspond with pass receipt locations at the playing area. In this way, the player knows where to stand to receive passes from the basketball launching machine 10 and the player is able to select particular areas to focus on, such as areas of weakness. The selectable area 62 may be provided on a 1:1 basis with such pass receipt locations, though any ratio may be utilized.

The interface 50 may comprise one or more areas 67 for selecting or specific one or more additional options such as, but not limited to, a time delay between passes, time code 82 is displayed (e.g., duration and/or timing of), availability of demonstrative images or videos and/or descriptive text with code, time delay between initial code 82 display and passing, a number of basketballs per location, pass speed, pass type, pass height, combinations thereof, or the like. In exemplary embodiments, the separate area(s) 67 may not be required and such options may be selected at the area with the visual depiction 52. The areas 67 may be part of the interface 50, or be separate therefrom. The areas 67, for example without limitation, may comprise further selectable areas of a touch screen, icons on an electronic display, dedicated button(s), combinations thereof, of the like.

The format of the location selection display 51 is exemplary and not intended to be limiting. As those of skill in the art will recognize, a wide variety of formats of the location selection display 51 may be utilized to facilitate pass location selection. Alternatively, or additionally, the location selection display 51 or other display may be used to specify shooting locations, which may be different from pass locations. In exemplary embodiments, unless otherwise specified (e.g., by user input or type of assigned basketball move for the pass), the controller 68 may be configured to assume that the pass location is also the shooting location.

In exemplary embodiments, the interface 50 may comprise a touch screen. In such embodiments, the various displays and/or display elements may be electronically generated electronic icons at the touch screen. The various displays and/or display elements may already be visible on the interface 50, such as in the form of indicia or icons, and may change when selected. In other such embodiments, the various displays and/or display elements may not be initially visible and may become visible when the corresponding area of the interface 50 is selected. Such selection may be performed by direct, individual, physical contact, though such is not required. The touch screen may comprise a resistive, capacitive, or other type of touch screen. Some or all of the various displays and/or display elements may be physically and/or electrically separated from one another or may be part of an undivided touch screen, display, panel, or the like.

Once selected, the selected ones of the various displays and/or display elements may be changed, such as by illumination, highlighting, color changes, appearance, disappearance, shape change, number or other indication change, filled in, combinations thereof, or the like.

In other exemplary embodiments, the interface 50 may comprise an electronic display. In such embodiments, the various displays and/or display elements (e.g., those shown and/or described herein) may be electronically generated on the electronic display. The various displays and/or display elements in such embodiments, may already be visible on the interface 50, such as in the form of indicia or icons, and may change when selected. Such selection may be performed by one or more indirect selection devices 64. Such indirect selection devices 64 may permit interaction with the images displayed on the electronic display. For example, without limitation, such indirect selection devices 64 may comprise a keypad, mouse, buttons, arrows, some combination thereof, or the like. The electronic display and/or touch screen may comprise an LCD, cathode ray, OLED, plasma, or other type of electronic display.

In still other exemplary embodiments, the interface 50 may comprise a static panel. In such embodiments, at least some of the various displays and/or display elements may be painted, printed, integrally formed, or otherwise provided on the interface 50 in a permanent or semi-permanent fashion. Other of the various displays and/or display elements, in such embodiments, may comprise buttons and/or illumination devices or the like which are configured to indicate whether the elements have been selected by a user. Such selection may be performed by direct, individual, physical contact, though such is not required.

In exemplary embodiments, the interface 50 may comprise a prompt type/format option 36. The prompt type/format option 36 may allow the user to select between using arbitrary prompts (e.g., the codes 82) and/or descriptive prompts (e.g., images, videos of the basketball moves) to prompt the player and/or the format of the prompts (e.g., images, video, audio). Combinations of the type and/or format of the prompts may be selected. The prompt type/format option 36 may be part of the basketball moves selection display 43 or separate therefrom.

The prompt type/format option 36 does not necessarily require that both prompt type and format options be made available. For example, the prompt type/format option 36 could allow a user to only select a prompt format or a prompt type.

In exemplary embodiments, without limitation, where audio, image, and/or video format type prompts are selected, they may, by default, be provided as descriptive prompts. In such embodiments, the prompt type option may not be required, for example without limitation. In such embodiments, the code assignment portion of the basketball moves selection display 43 may not be required, for example without limitation.

The audio (descriptive or otherwise) may be provided in a user specified language, a default language (e.g., English), or in a different language from the user specified language and/or a default, non-English language (e.g., Spanish). This may serve as a kind of code 82 as the user may be forced to recall what the word is intended to convey (e.g., as a translation and/or code).

Figure 5:
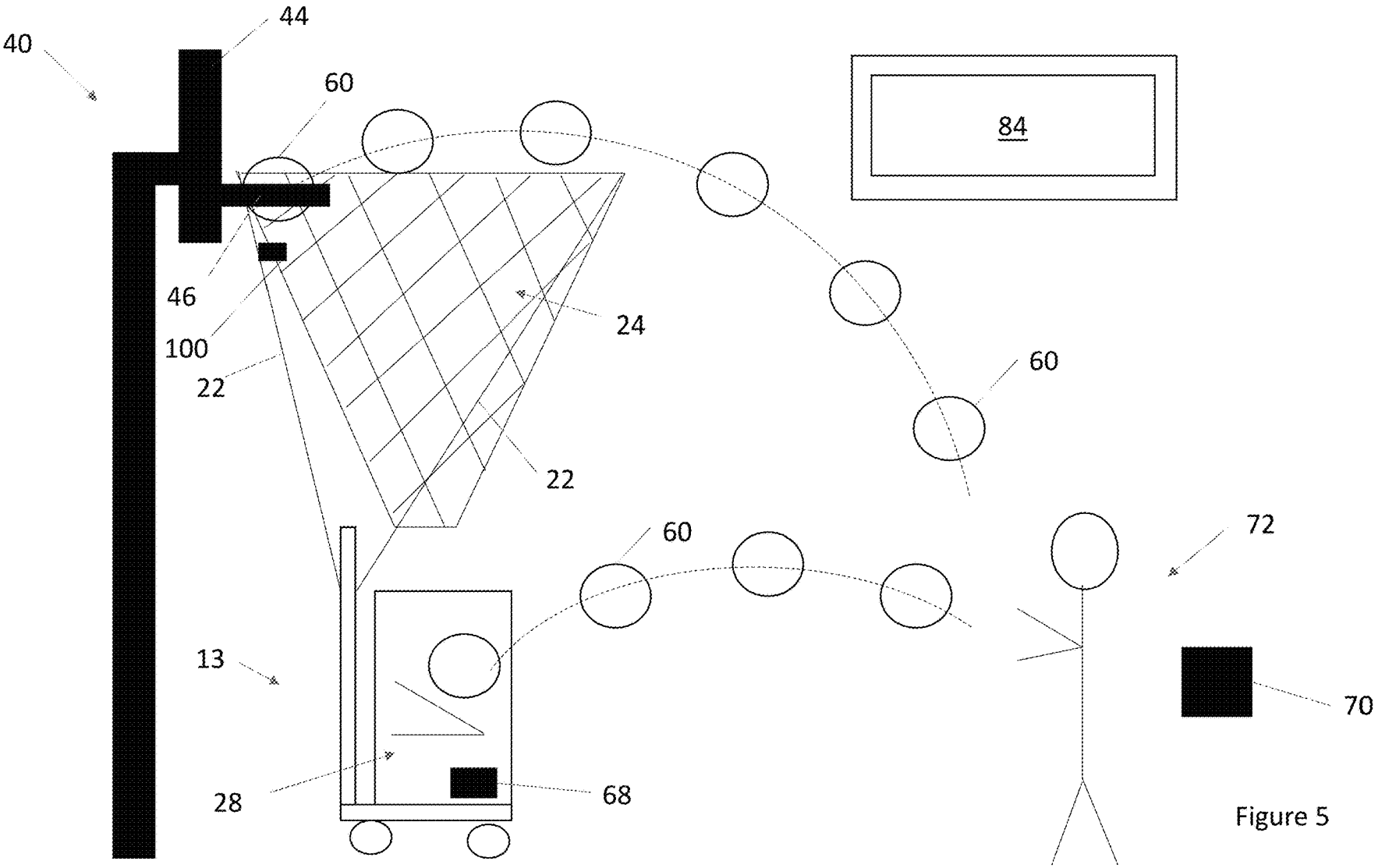
FIG. 5 is a side view of the FIG. 1 device with certain, internal elements and exemplary basketballs being passed and shot illustrated.

FIG. 5 is a side view of the basketball launching device 10 with certain elements of the housing 16 removed to illustrate the launcher 28. The launcher 28 may be configured to launch one or more basketballs 60 to one or more pass receipt locations at the playing area 30 for a player 72 to catch, optionally perform some basketball move, and shoot towards the basketball goal 40. For example, without limitation, the launching device 28 may comprise a catapult arm, thrower, wheeled device, pneumatic device, some combination thereof, or the like. Any kind or type of launching device 28 may be utilized. The launcher 28 may be mounted to the housing 16 and/or the support structure 12 in a rotatable manner, though such is not required.

The interface 50 may be placed in electronic communication with a controller 68. The controller 68 may be located at the housing 16, though any location of the controller 68 may be utilized, including but not limited to at a remote location such as a server and/or personal electronic device 70. The controller 68 may comprise one or more electronic storage devices with executable software instructions and one or more processors. Alternatively, or in addition, the controller 68 may be part of one or more other components of the basketball launching device 10 including but not limited to, the detector(s) 100 and the interface 50. The controller 68 may be configured to receive electronic signals from the interface 50 regarding the user's selection of the selectable areas 62 to form a custom practice arrangement and may program the launcher 28 to pass basketballs 60 to each of the pass receipt locations at the playing area 30 corresponding to each of selectable areas 62 selected by the user at the interface 50 to perform the custom practice arrangement. The controller 68 may be configured to, alternatively or additionally, receive input from the interface 50 including user selection of the selection devices 64, area 67, pre-programmed drill, user preferences, other options, some combination thereof, or the like and program the launcher 28 and/or display such user selections at the interface 50 in accordance with the received input.

The basketball launching device 10 may be positioned in proximity to the basketball goal 40 such that the basketballs 60 passing through the rim 46, and at least some of the basketballs 60 bouncing off the backboard 44 but not necessarily passing through the rim 46 or otherwise resulting in a missed shot (i.e., not passing through the rim 46), may be captured in the net 24. The detector(s) 100 may be positioned below and adjacent to the rim 46 in exemplary embodiments, without limitation. In this way, the detector(s) 100 may be configured to detect a presence of any basketballs 60 passing through the rim 46.

Figure 6:
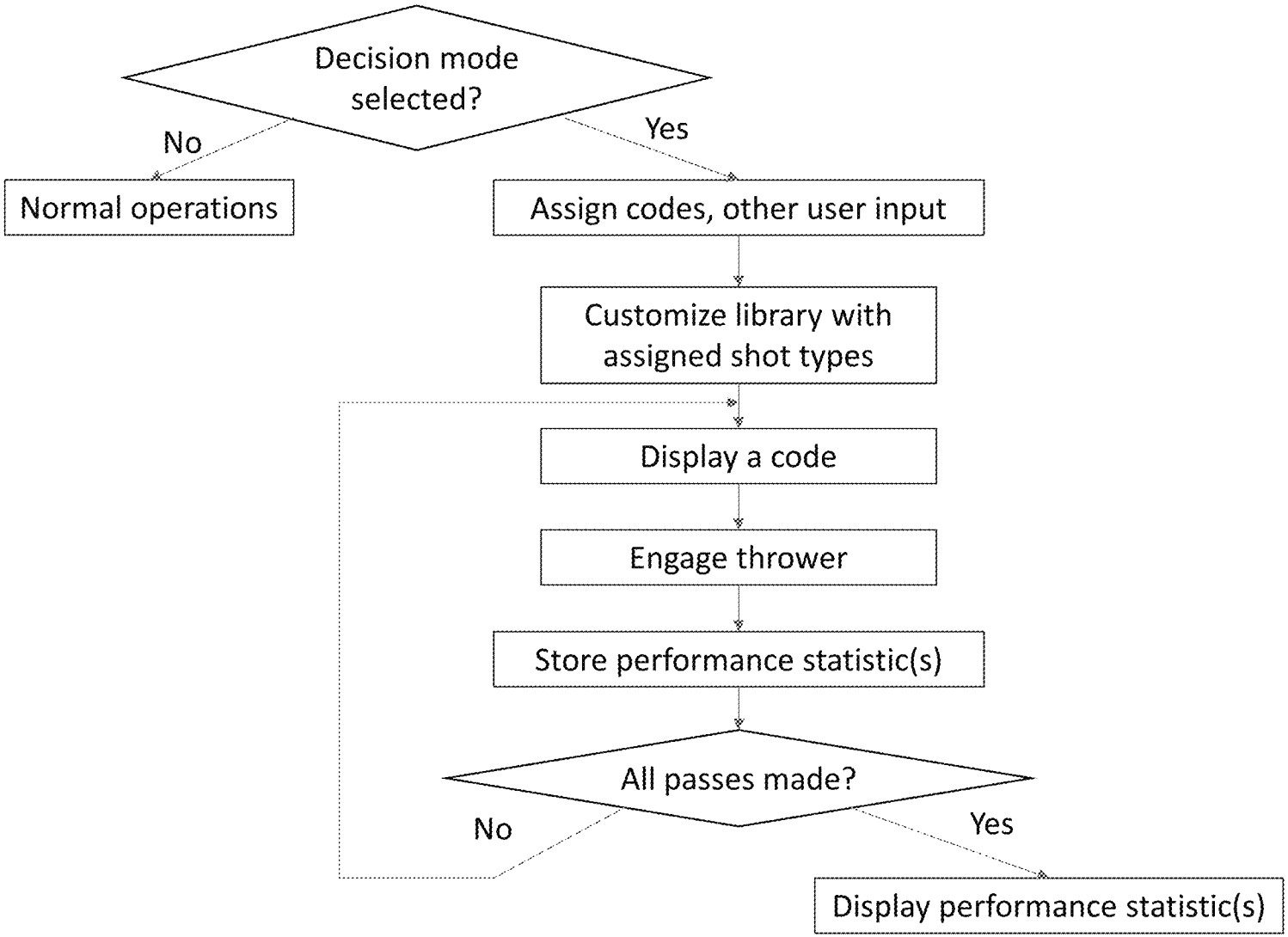
FIG. 6 is a flow chat with exemplary logic for operating the basketball training device of FIG. 1.

FIG. 6 illustrates an exemplary flow chart for operating the device 10 to provide certain mental training feature(s), such as by way of the decision mode. In exemplary embodiments, without limitation, a user indicates a desire to activate the decision mode for the session, such as by way of selection of the decision mode option 41 at the user interface 50. Basketball moves may be selected manually by the user, such as by way of the basketball moves selection display 43 at the user interface 50, or automatically, such as by way of the controller 68. Manual selection may be made, for example without limitation, by drop down menu, clicking or otherwise electing displayed basketball moves, combinations thereof, or the like. Codes 82 for each of the selected basketball moves may be assigned automatically, such as by way of the controller 68, or manually specified by the user, such as by way of the basketball moves selection display 43 at the user interface 50. Manual assignment may be made, for example without limitation, by drop down menu, clicking and dragging displayed basketball moves to available codes 82 or vice versa, combinations thereof, or the like. Optionally, demonstrative images and/or videos may be displayed of the basketball moves, such as at the user interface 50, optionally with the assigned codes 82. These may be provided as an educational tool for the player, so the player knows what is expected of him or her and/or to refresh their recollection on the selected moves and/or the assigned codes 82.

Other user input may be provided, such as number and/or location of passes, player information (e.g., player and/or team identification and/or number of players), time delay between passes, time allotted for player to make shot, time code 82 or other information is displayed/provided, time delay between initially prompting player (e.g., with code 82) and launching basketball, combinations thereof, or the like. Such other user input may be user specified at the interface 50. Alternatively, or additionally, default settings may be utilized by the controller 68. For example, not all options may be made available for user specification (e.g., predetermined), or if available but not specified may be assigned by default. Data indicating the user input at the interface 50 may be communicated to the controller 68.

A custom library of assigned basketball moves may be created, such as at the controller 68, based on the user selections. The custom library may comprise the selected basketball moves and/or assigned codes 82 for the challenge based on the user manual selection/assignment and/or controller 68 automatic selection/assignment. This customized library may be generated and/or stored at the controller 68, by way of non-limiting example. The custom library may comprise a database of the selected/assigned moves and/or codes, a listing, table, data field, combinations thereof, or the like of the selected/assigned moves and/or codes 82 generated from a larger library/database of available basketball moves/codes, combinations thereof, or the like. For each basketball pass of the session, the controller 68 may reference the customer library to determine a next pass and command the device 10 accordingly. For example, without limitation, the controller 68 may need to determine the code 82 to be displayed, the speed, height, and/or other characteristics of the pass to be made, pass location, type of pass and/or shot to associate the subsequent performance statistics (e.g., update made or missed shots statistics by an associated pass location, assigned shot type, player ID, etc. for the pass), combinations thereof, or the like.

In exemplary embodiments, without limitation, before and/or while each basketball pass is made, the controller 68 is configured to display the assigned one of the codes 82, such as at an electronic display visible to a player, which may be at the interface 50. The code 82 may be provided at, and/or as part of, a code display 80, such as the code display 80 of FIG. 8, by way of non-limiting example. Alternatively, or additionally, the code 82 may be displayed by some other mechanism, such as lights and/or sound, by way of non-limiting example.

While the code 82 may be provided at the interface 50, the code 82 and/or code display 80 may alternatively or additionally be provided at one or more additional electronic displays 84. Such additional electronic display(s) 84 may be provided at the machine 10 or separate therefrom, such as at electronic displays for a basketball gym or other shooting facility, positioned elsewhere at the basketball playing area, combinations thereof, or the like. Such additional electronic display(s) 84 may be in wired and/or wireless connection with the controller 68. The additional electronic display(s) 84 may be visible to the player and/or a third party (e.g., coach, audience, spectators, etc.).

The code 82 and/or basketball moves may be drawn randomly from the customized library and/or the customized library may be generated with a randomly generated listing of the basketball moves and/or associated codes 82. Stated another way, the basketball moves and/or codes 82 may be randomly listed at the library and/or drawn randomly from the same. For example, without limitation, a random number generator may be used to select the corresponding numbered basketball move and associated code 82 from the library, which may itself optionally be randomized. Randomization may be performed using any one or more of various known techniques.

Preferably, the code 82 is displayed only briefly, though the code 82 may be displayed continuously until a next code 82 is displayed or for another duration, at intervals, or the like. The amount of time the code 82 is displayed may be a user defined variable, such as by way of the user interface 50. As used herein, the term briefly may refer to a period of time of under one minute, preferably within about 5 seconds, more preferably under 3 seconds. Shortly after the code 82 is initially displayed, simultaneously, or shortly before, the throwing mechanism 28 is engaged to pass the basketball with, or shortly after, the code 82 is initially displayed. As used herein, the term shortly may refer to a period of time of under one minute, preferably within about 5 seconds, more preferably under 3 seconds. In this way, the player may be forced to mentally recall the basketball move assigned to the displayed code 82 and perform the move before, with, or after receiving the basketball pass from the throwing mechanism 28, as appropriate for the assigned basketball move. The delay between at least initially displaying (or finally displaying) the code 82 and passing the basketball may be a user defined variable, such as by way of the user interface 50. For example, without limitation, the delay may be about 1 second, under 3 seconds, or under 1 minute.

Optionally, demonstrative images, videos, and/or descriptive text may be displayed with the code, such as an additional reminder to the player, if needed. Such images, text, and/or video may, for example, be displayed in a training mode, during a first round of passes for the challenge, and/or in response to user input (e.g., touch input, voice command).

User performance (e.g., makes/misses) may be determined automatically, such as at the controller 68, based on data received (or not received) from the shots made detector 100. The controller 68 may be configured to automatically associate the makes/misses, determined based on the data from the detector 100, with last made passes (e.g., by associated basketball move, player ID, pass location, etc.). Preferably, the performance statistics are organized, such as by way of the controller 68, by player identification, team identification, basketball moves (e.g., assigned basketball move), shooting challenge (e.g., decision mode), combinations thereof, or the like. The performance statistics may be stored at the controller 68 or one or more local or remote databases (e.g., cloud servers) by way of non-limiting example. The process of displaying codes, engaging the throwing mechanism 28, and storing/updating performance statistics may be performed for all passes of the challenge until completed. While performance statistics may optionally be displayed during the challenge, such as at the interface 50, the performance statistics for the entire challenge may, alternatively or additionally, be displayed upon completion, such as at the interface 50.

An exemplary display of performance statistics is illustrated with the performance display 102 of FIG. 7. The type of data display, format, organization, and the like is merely exemplary and not intended to be limiting. As those of skill in the art will recognize, a variety of collected data may be displayed in various ways. The performance display 102 may be generated at the user interface 50, the electronic device(s) 70, at other displays/interfaces, combinations thereof, or the like.

Figure 9:
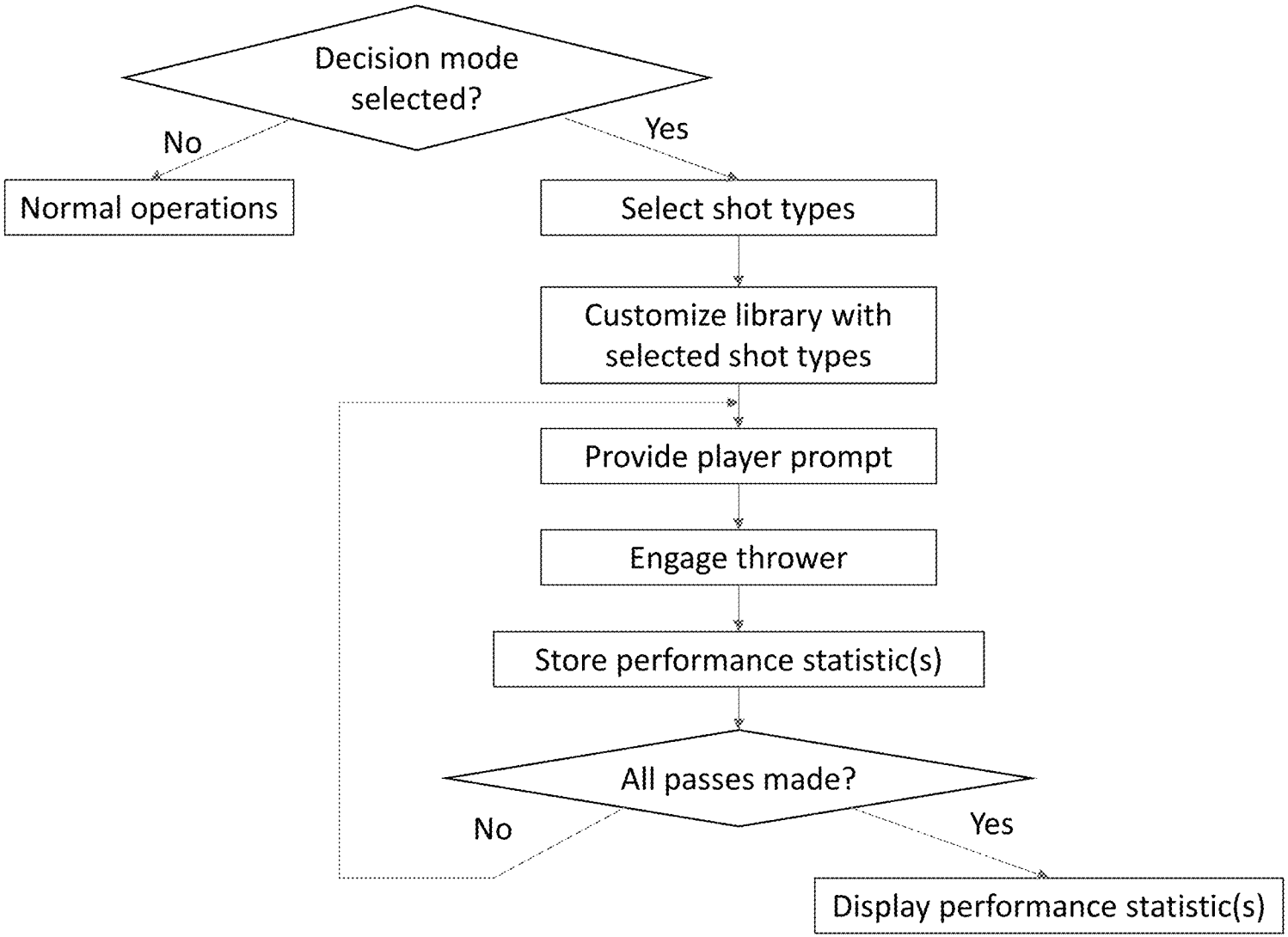
FIG. 9 is a flow chat with other exemplary logic for operating the basketball training device of FIG. 1.

Various types and/or formats of prompts may be provided to the player for the basketball move to be performed, such as illustrated with particular regard to FIG. 9. The type(s) and/or format of prompts to be provided (e.g., code 82, descriptive information, images, video, audio) may be provided in accordance with user selections made at the prompt type/format option 36.

Audio formatted prompts may be provided by one or more speakers 38. The speakers 38 may be provided at the device 10 and/or remote therefrom. For example, without limitation, the speakers 38 may be in electronic wireless communication with the controller 68. The audio formatting prompt may be descriptive and/or suggestive of the basketball move to be performed. For example, without limitation, the prompt may describe the basketball move (e.g., screen right, dribble left, etc.). This may force the player to process the audio command before making the move. Alternatively, or additionally, the audio formatted prompt may be suggestive and/or arbitrary, such as an audio description of the code 82 (e.g., red, triangle, etc.). This may force the player to process the audio command and recall the assigned move before making the move. The audio prompts may be prerecorded and/or generated using speech-to-text software, such as stored at the controller 68.

Visual formatted prompts (e.g., images and/or videos) may be provided at the display 50 and/or additional display(s) 84. Such image and/or video formatted prompts may comprise arbitrary type prompts (e.g., the code 82) and/or descriptive type prompts (e.g., text describing/naming basketball move, image showing some or all of the basketball move, video showing some or all of the basketball move, combinations thereof, or the like).

Where the selection at the prompt type/format option 36 is only of descriptive type prompts, code assignment may not be required.

Figure 10:
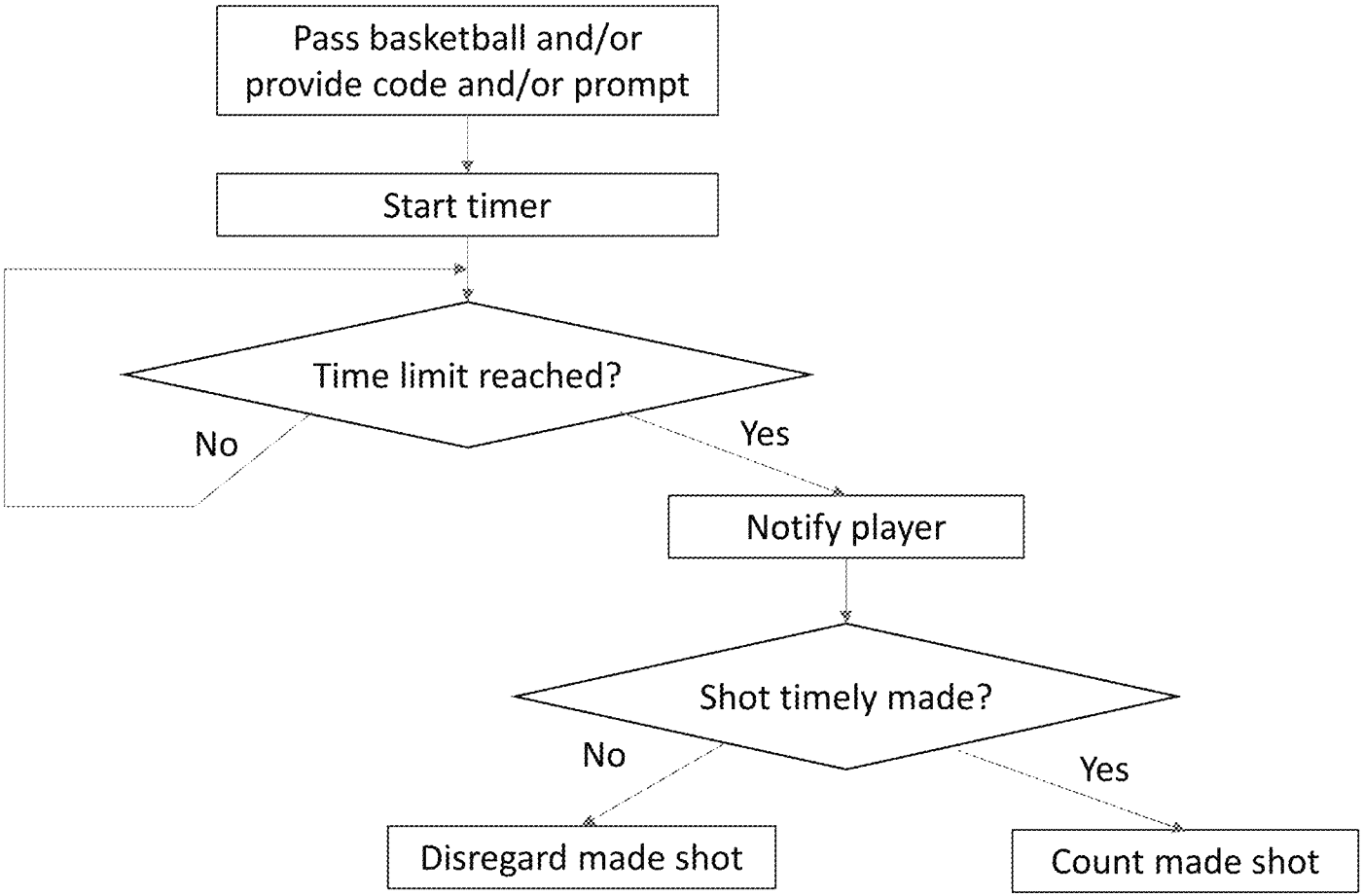
FIG. 10 is a flow chat with other exemplary logic for operating the basketball training device of FIG. 1.

With particular regard to FIG. 10, the controller 68 may optionally be configured to only count made basketball shots where such shots are made within a predetermined amount of time. Once a basketball is passed, either as sensed by a sensor, movement of the launching device 28, issuance of a launch command by the controller 68, combinations thereof, or the like, a timer may be started and/or elapsed time may otherwise be tracked. Alternatively, the timer may be started and/or time elapse may be tracked from, a time the initial display of the code 82 is commanded, initial provision of the prompt is commanded, combinations thereof, or the like. For example, without limitation, such timers and/or elapsed time may be tracked by issuance of commands from the controller 68, such as by way of software-based timer or clocks provided at the controller 68.

In exemplary embodiments, once a predetermined amount of time is elapsed (e.g., timer reaches threshold, or the like), the player may be informed. The player may be informed by a visual and/or audio prompt by way of non-limiting example. The visual prompt may comprise descriptive text (e.g., "TIMES UP") and/or no longer displaying the code 82, such as at the display 50 and/or additional display 84. The audio prompt may comprise a buzzer or other audio command (e.g., "TIMES UP"), such as issued from the speaker(s) 38. Combinations or similar variations of the foregoing may be utilized. This notification is optional.

The controller 68 may be configured to essentially disregard any made shots after the predetermined amount of time as been reached or elapsed (e.g., from basketball launch or when prompt/code provided). For example, without limitation, once a launch command is issued, the player may be provided with 5 seconds to complete their basketball move and make a shot, such as tracked by the controller 68. 5 seconds is merely exemplary and not intended to be limiting. Any number of seconds, minutes, or the like may be used as a parameter. Preferably, the time limit is a predetermined amount, which may optionally be user selected (e.g., at the interface 50) or assigned by default. The time allotted may be anywhere between 2 and 30 seconds, by way of non-limiting example. Regardless, this feature may force the player to timely recall the move, perform the move, and attempt a shot. Any shot determined to be made within the window may be recorded, any shot determined to be made thereafter may be disregarded.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention.

Certain operations described herein may be performed by one or more electronic devices. Each electronic device may comprise one or more processors, electronic storage devices, executable software instructions, combinations thereof, and the like configured to perform the operations described herein. The electronic devices may be general purpose computers or specialized computing devices. The electronic devices may comprise personal computers, smartphones, tablets, databases, servers, or the like. The electronic connections and transmissions described herein may be accomplished by one or more wired or wireless connectively components (e.g., routers, modems, ethernet cables, fiber optic cable, telephone cables, signal repeaters, and the like) and/or networks (e.g., internets, intranets, cellular networks, the world wide web, local area networks, and the like). The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold, solely non-transitory signals.

What is claimed is:

1. A system for providing mental training during a basketball practice session, said system comprising:

an electronic display;

a basketball passing machine comprising a launching device for passing basketballs; and a controller in electronic communication with the electronic display and the launching device, wherein said controller comprises software instructions, which when executed, configure the controller to:

generate a custom library of selected basketball moves and associated codes for the basketball practice session; and before and/or while issuing a command to the launching device to pass a basketball for the basketball practice session, cause one of the associated codes to be displayed at the electronic display.

2. The system of claim 1 wherein:

the controller comprises additional software instructions, which when executed, configure the controller to generate an interactive display of available basketball moves and available codes, which includes the selected basketball moves and the associated codes for the basketball practice session, wherein said display facilitates user manual selection of some or all of the available basketball moves and manual assignment of some or all of the available codes to the selected basketball moves, and wherein the custom library is generated based, at least in part, on user input data received in response to generation of the interactive display.

3. The system of claim 1 wherein:

the controller comprises additional software instructions, which when executed, configure the controller to:

generate an interactive display comprising a list of available basketball moves, which includes the selected basketball moves for the basketball practice session, wherein said display facilitates user manual selection of some or all of the available basketball moves; and randomly assign some or all of available codes, which includes the associated codes for the basketball practice session, based, at least in part, user input data received in response to generation of the interactive display, wherein the custom library is generated based, at least in part, on the user input data received in response to generation of the interactive display and the random assignment of the available codes.

4. The system of claim 1 wherein:

the codes comprise any one or more of: colors, images, shapes, and symbols;

each of the codes is arbitrary to all of the available basketball moves;

each of the codes are displayed as part of a code display generated by the controller at the electronic display;

the code display is devoid of descriptive and suggestive content regarding any of the available basketball moves.

5. The system of claim 1 wherein:

the basketball moves comprise any one or more of: shot fake and floater, step back, shoot now, shot off right dribble, and shot off left dribble.

6. The system of claim 1 wherein:

the controller comprises additional software instructions, which when executed, configure the controller to:

receive indication of user selection of a decision mode for the basketball practice session; and generate one or more user interface displays for receiving the indication of user selection of the decision mode and additional user input for generating the custom library.

7. The system of claim 6 wherein:

the controller is configured to generate the one or more user interface displays at the electronic display.

8. The system of claim 7 wherein:

the basketball passing machine comprises the electronic display and the controller.

9. The system of claim 8 wherein:

the basketball passing machine comprises a frame, a housing, and a collection net connected to the frame; and the electronic display comprises a touch screen permanently affixed to at least one of: the frame and the housing.

10. The system of claim 7 wherein:

the electronic display and the controller are remote from the basketball passing machine.

11. The system of claim 10 further comprising:

an electronic device comprising the electronic display and the controller, wherein the electronic device is any one or: a smartphone, a personal computer, and a tablet.

12. The system of claim 1 further comprising:

a detector in electronic communication with the controller for detecting made/missed basketball shots, wherein the controller comprises additional software instructions, which when executed, configure the controller to:

associate made/missed statistics with each of the selected basketball moves of the custom library based on data received from the detector; and generate a performance feedback display for the basketball practice session comprising the made/missed statistics displayed on a basketball move specific basis.

13. The system of claim 12 wherein:

the detector comprises any one or more of: a photo eye, a laser, a camera, a physical obstruction, a switch, an ultrasonic emitter/detector, and a microphone.

14. The system of claim 1 wherein:

the controller comprises additional software instructions, which when executed, configure the controller to:

generate one or more prompts at the electronic display requesting user input regarding a number of passes for the basketball practice session and a location of passes for the basketball practice session; and command the basketball passing machine to pass the user specified number of passes to the user specified locations.

15. The system of claim 1 wherein:

the controller comprises additional software instructions, which when executed, configure the controller to:

generate one or more prompts at the electronic display requesting user input regarding a time delay between displaying the associated codes and passing the basketballs for the basketball practice session; and command the basketball launching machine to operate in accordance with the user input received in response to the prompt for the basketball practice session.

16. The system of claim 1 wherein:

the launching device comprises a catapult mechanism.

17. The system of claim 1 wherein:

the controller comprises additional software instructions, which when executed, configure the controller to:

select one of the selected basketball moves and associated codes from the custom library in a randomized order for each basketball pass of the basketball practice session.

18. A method for providing mental training during a basketball practice session, said method comprising:

receiving, at a controller, indication of user selection of a decision mode for the basketball practice session, wherein said controller is associated with a basketball passing machine comprising a launching device for basketballs, and wherein said controller is in electronic communication with an electronic display associated with the basketball passing machine;

generating, at the controller, a custom library of basketball moves and associated codes for the basketball practice session;

for each basketball pass of the basketball practice session:

displaying one of the codes at the electronic display; and subsequently, passing the basketballs by way of the launching device.

19. The method of claim 18 wherein:

the electronic display and the controller located at to the basketball passing machine.

20. A basketball passing machine for providing mental training during a basketball practice session, said basketball passing machine comprising:

a launching device for passing basketballs;

a touch-sensitive electronic display;

a support structure for at least the launching device and the touch-sensitive electronic display; and a controller in electronic communication with the electronic display and the launching device, wherein said controller comprises software instructions, which when executed, configure the controller to:

generate one or more user interface displays at the touch-sensitive electronic display comprising an option to initiate a decision mode for the basketball practice session;

upon receipt of data indicating user selection of the decision mode at the one or more user interface displays, generate one or more further user interface displays at the touch-sensitive electronic display comprising a display of available basketball moves and available codes;

receive data indicating user selection of at least certain of the available basketball moves at the one or more further user interface displays;

receive data indicating further user selection assigning, individually, for each of the selected basketball moves, a respective one of the available codes at the one or more further user interface displays;

generate a custom library of the selected basketball moves and the assigned codes for the basketball practice session;

for each basketball pass of the basketball practice session:

randomly select one of the selected basketball moves of the custom library; and command the electronic display to generate a code display comprising the respective one of the assigned codes associated with the randomly selected one of the selected basketball moves and command the launching device to launch a respective one of the basketballs such that the code display with the respective one of the assigned codes is at least initially displayed at the electronic display before the launching device releases the respective one of the basketballs;

wherein each of the available codes comprises a symbol and/or color which is arbitrary to all of the available basketball moves and the code display is devoid of descriptive and suggestive content regarding any of the available basketball moves.

* * * * *